US006609720B2

(12) United States Patent
Marmonier

(10) Patent No.: US 6,609,720 B2
(45) Date of Patent: Aug. 26, 2003

(54) SNOWBOARD BINDING

(75) Inventor: Gilles Marmonier, St-Etienne de Crossey (FR)

(73) Assignee: Skis Rossignol S.A., Voiron (FR)

( * ) Notice: Subject to any disclaimer, the term of this patent is extended or adjusted under 35 U.S.C. 154(b) by 0 days.

(21) Appl. No.: 09/781,706

(22) Filed: Feb. 12, 2001

(65) Prior Publication Data

US 2001/0013686 A1 Aug. 16, 2001

(30) Foreign Application Priority Data

Feb. 15, 2000 (FR) ..... 00 01834

(51) Int. Cl.[7] ..... A63C 9/02
(52) U.S. Cl. ..... 280/14.24; 280/618
(58) Field of Search ..... 280/14.21, 14.22, 280/14.24, 11.36, 617, 618

(56) References Cited

U.S. PATENT DOCUMENTS

| | | | | | |
|---|---|---|---|---|---|
| 566,694 | A | * | 8/1896 | Libbey | 280/11.36 |
| 805,667 | A | * | 11/1905 | Riblet | 280/11.36 |
| 926,646 | A | * | 6/1909 | Eubank, Jr. | 280/11.36 |
| 1,167,183 | A | * | 1/1916 | King | 280/11.36 |
| 5,261,689 | A | | 11/1993 | Carpenter et al. | |
| 5,727,797 | A | | 3/1998 | Bowles | |
| 5,769,446 | A | | 6/1998 | Borsoi | |
| 5,971,407 | A | | 10/1999 | Zemke et al. | |
| 6,116,635 | A | | 9/2000 | Rigal | |
| 6,231,057 | B1 | * | 5/2001 | Reuss et al. | 280/14.21 |
| 6,283,492 | B1 | * | 9/2001 | Hale | 280/11.36 |
| 6,406,040 | B1 | * | 6/2002 | Thorne | 280/14.21 |

FOREIGN PATENT DOCUMENTS

| | | |
|---|---|---|
| DE | 91 13 766 U | 2/1992 |
| DE | 196 03 790 A | 4/1997 |
| DE | 297 00 632 U | 6/1997 |
| EP | 0 749 766 A | 12/1996 |
| EP | 0 933 100 A | 8/1999 |
| FR | 2 751 238 A | 1/1998 |
| WO | WO 93 14835 A | 8/1993 |
| WO | WO 97 28858 A | 8/1997 |
| WO | WO 98 42419 | 10/1999 |

OTHER PUBLICATIONS

French Preliminary Search Report in SN FR 0001834.

* cited by examiner

*Primary Examiner*—Avraham Lerner
(74) *Attorney, Agent, or Firm*—Bugnion S.A.; John Moetteli

(57) ABSTRACT

Snowboard binding comprising a base (1) intended to be fixed to a snowboard and having side walls (2, 3) connected at the rear by a bow shaped structure (4), a curved support plate (5) articulated relative to the base between the side walls at two opposed points. This support plate (5) is articulated to an auxiliary support (6) secured to the base (1) either by being fixed directly to the base or by being fixed to the base via an intermediate component. The auxiliary support is preferably between the side walls (2, 3). Greater versatility in the mounting of the support plate on the base is achieved, and the mounting enables the fore-aft adjustments to be dissociated from the other adjustments.

9 Claims, 7 Drawing Sheets

Fig.7
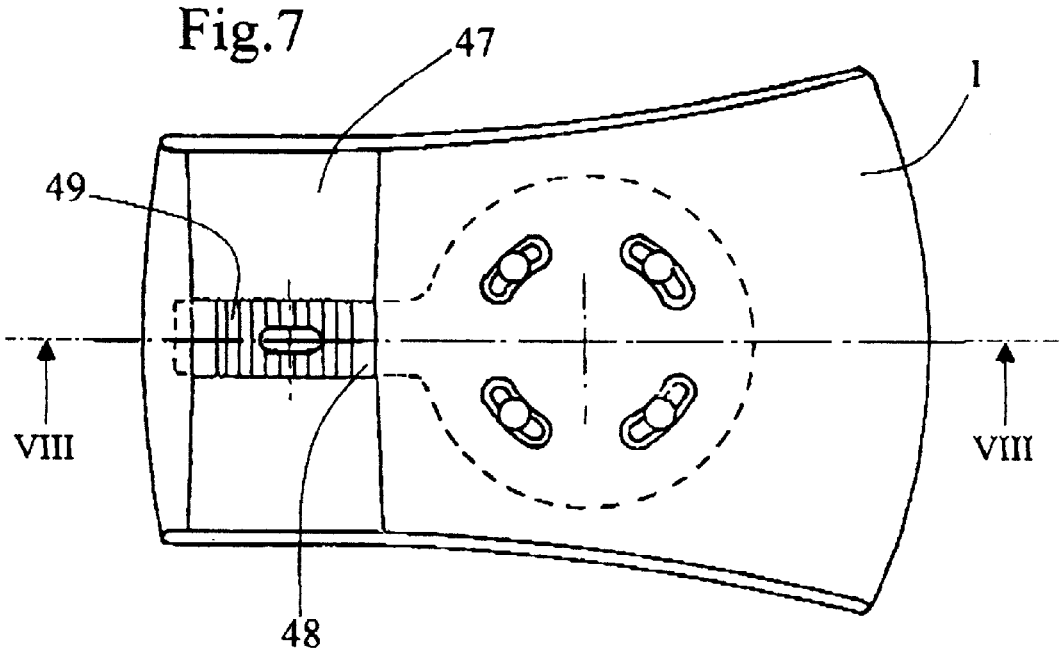
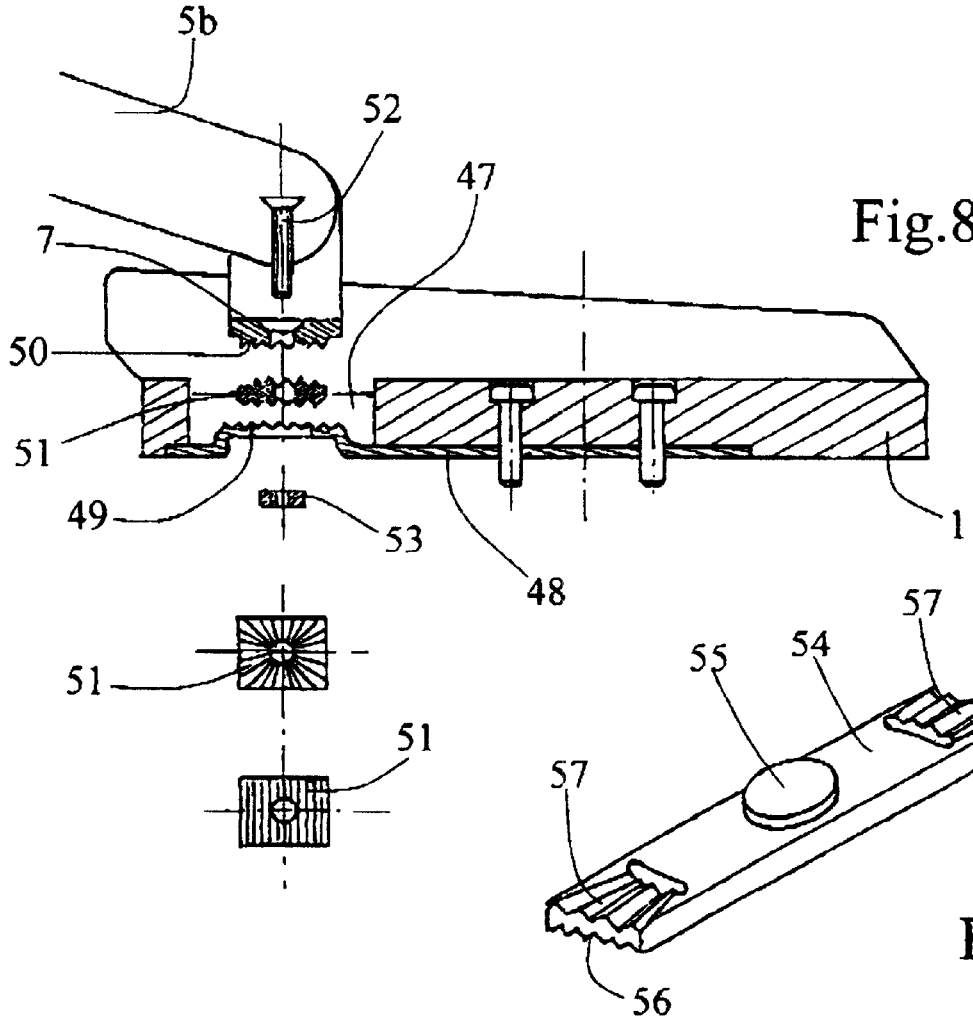
Fig.8
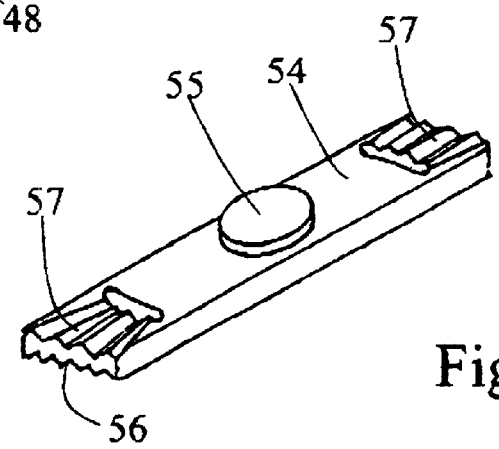
Fig.9

SNOWBOARD BINDING

BACKGROUND OF THE INVENTION

The invention relates to a snowboard binding comprising a base intended to be mounted on a snowboard and having side walls connected at the rear by a bow, a curved support plate articulated relative to the base between the side walls at two opposed points and the curvature of which corresponds roughly to the curvature of the bow.

In known bindings, the curved support plate is mounted on the flanges of the base. Such mounting restricts the mounting and adjustment options.

As far as adjustment is concerned, the possibility of multidirectional adjustment is a sensible choice in order, on the one hand, to be able to adapt the binding to suit the boot size and, on the other hand, in order to be able to adapt the position of the support plate to the build and technique of the user. This second type of adjustment can be made, on the one hand, by rotating the support plate about its axis of curvature and, on the other hand, by inclining the axis of articulation of the support plate relative to the plane of the base.

PRIOR ART

Patent WO 93/14835 discloses a snowboard binding, the base and the bow of which constitute a monobloc piece and in which the curved support plate is articulated to the side walls of the base by means of two screws and nuts passing through slots allowing the position of the curved support plate to be adjusted in the fore and aft directions and allowing its position to be modified approximately about its axis of curvature.

Patent Application WO 98/42419 describes a binding of the same type in which the slots are replaced by two holes located on an oblique line, the arms of the bow being equipped with several holes allowing adjustment.

Patent EP 0 749 766 describes a binding with a monobloc base and bow, in which binding the curved support plate is articulated to the side walls of the base without any possibility for adjustment.

In these bindings, the possibilities for adjusting the position of the curved support plate, in so far as these possibilities exist, are limited. In the binding according to WO 93/14835, the fore-aft adjustment and the adjustment about the axis of curvature of the support plate are combined and there is no height-wise adjustment. In the binding according to WO 98/42419, the adjustments are also combined. There is also known a board binding marketed under the JOKER brand, in which the adjustments are separate. This binding comprises a metal base to which the bow is attached adjustably by means of four screws and nuts. The curved support plate is itself articulated adjustably to the bow by means of screws and nuts. Adjustment, particularly fore-aft adjustment, entails unscrewing and re-tightening four screws and nuts. Adjusting the bow also entails unscrewing and re-tightening screws and nuts. Such adjustments are not only complicated with the risk of losing the nuts, but what is more, the screws project from the sides of the binding, and this may present a hazard.

SUMMARY OF THE INVENTION

The object of the invention is essentially to offer a certain versatility in the mounting of the support plate on the base.

This object is achieved by the binding according to the invention wherein the curved support plate is articulated to an auxiliary support secured to the base between the side walls.

The auxiliary support may be fixed directly to the base or may rotate as one with the base by means of an intermediate component.

When positional adjustment of the support plate is envisaged, mounting such as this has the advantage of allowing the fore-aft adjustments to be dissociated from the other adjustments.

In the embodiments of the invention, the adjustments also do not require the removal of nuts and screws, and the binding has no lateral projection.

The bow is preferably formed integrally with the base.

The fore-aft position of the support plate may be adjusted by shifting its auxiliary support. The latter may be located entirely between the side walls, no piece or part of a piece projecting outside these side walls. The fore-aft adjustment can be accomplished without losing the adjustment of the position of the support plate on its auxiliary support. Likewise, the position of the support plate on its auxiliary support can be adjusted without losing the adjustment of its fore-aft position on the base.

According to a preferred embodiment of the invention, the auxiliary support has a crosspiece housed in a housing formed in the underside of the base or of the intermediate component, this crosspiece being fitted with two cheeks passing through the base near the side walls of the base. The auxiliary support is thus practically entirely housed under the base.

According to one embodiment, the crosspiece and the end of the housing have notched zones collaborating with each other to position the auxiliary support relative to the base. According to one embodiment, these notched zones are centered on the crosspiece and in the housing and the binding comprises an intermediate plate mounted between the crosspiece and the end of the housing, this plate having, on its top side, at least one radial notching collaborating with at least one radial notching of the crosspiece so as to orientate the auxiliary support about an axis perpendicular to the base and, on its underside, at least one transverse notching collaborating with the transverse notching of the end of the housing so as to position the auxiliary support longitudinally.

According to one embodiment of the invention, the binding is fitted with a heel pad connected to the auxiliary support so that it moves with it.

The invention can be applied to bindings without adjustment.

BRIEF DESCRIPTION OF THE DRAWINGS

The appended drawing depicts, by way of example, a number of embodiments of the invention.

FIG. 7 is a view from above of the base according to a third embodiment.

FIG. 8 is a view in section on VIII—VIII of FIG. 7, with the auxiliary support depicted in an exploded view FIG. 9 depicts an alternative form of the preferred embodiment.

DESCRIPTION OF THE PREFERRED EMBODIMENT(S)

Figure 1:
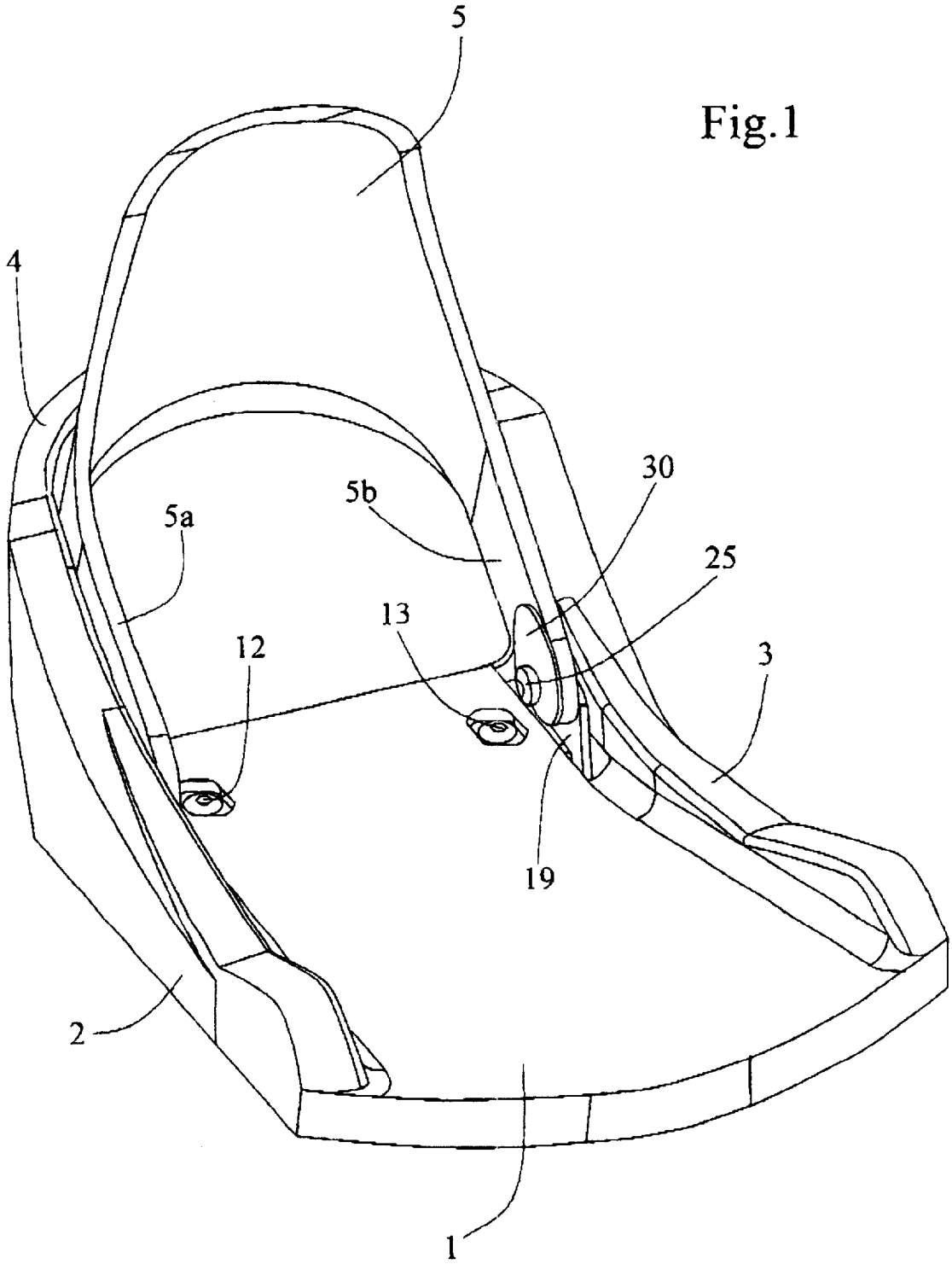
FIG. 1 is a perspective view of a first embodiment of the binding without the actual boot-attachment means.

The binding depicted in FIG. 1 comprises a base 1 intended to be mounted on a snowboard, possibly via a platform allowing this base to be orientated with respect to the longitudinal axis of the board. This base 1 has two roughly vertical and parallel side walls 2 and 3 connected at the back by a bow 4 formed integrally with the base 1. FIG. 1 does not depict the actual boot-attachment means. Various solutions can be used for this attachment, particularly a pair of straps fitted with buckles.

The binding comprises a curved support piece 5 mounted between the side walls 2 and 3 of the base, and the curvature of which corresponds to the curvature of the bow 4 against which it can bear. The support piece 5 serves, in a known way, to support the rear of the footwear, particularly the boot, of the user.

Figure 2:
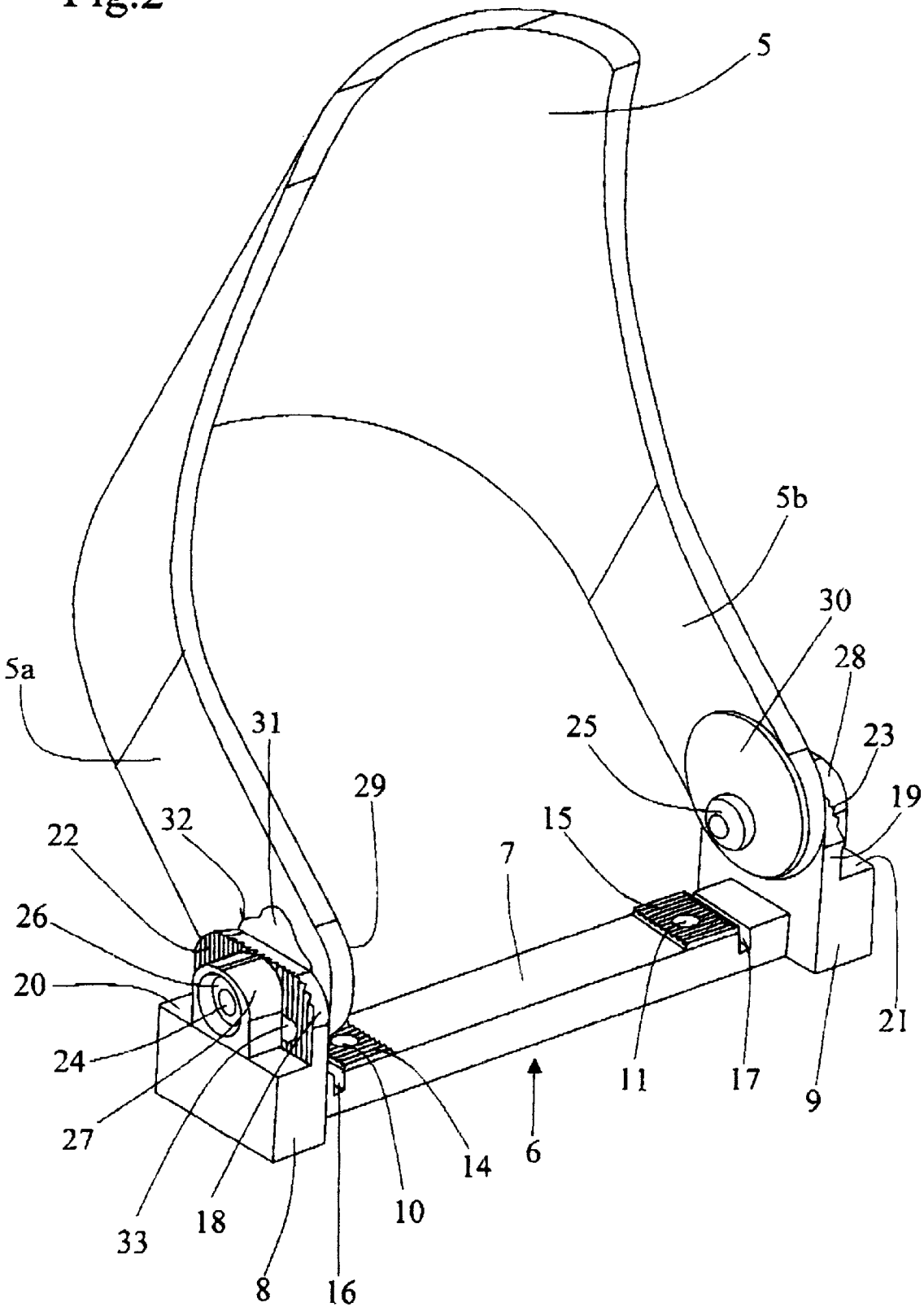
FIG. 2 depicts the auxiliary support carrying the curved support piece.

The binding differs from the known constructions in that the support piece 5 is not articulated to the side walls 2 and 3 or to the bow 4, but is articulated to an auxiliary support 6 (FIG. 2). This auxiliary support consists of a crosspiece 7 of rectangular cross section, the extremities of which are fitted with two cheeks 8 and 9 which are mutually parallel and arc perpendicular to the crosspiece. The crosspiece 7 has two holes 10 and 11 for the passage of screws 12 and 13 for attaching it to the base 1. On the top side of the crosspiece the zones 14 and 15 surrounding the holes 10 and 11 are notched transversely to the crosspiece. On the top side of the crosspiece 7 there are also two guide grooves 16 and 17 which are mutually parallel and oriented at right angles to the axis of the crosspiece.

The cheeks 8 and 9 have a thinner upper part 18 and 19 respectively, defining a flat and horizontal bearing surface 20 and 21 respectively, and the outer vertical face 22 and 23 respectively of which is notched in the same direction as the zones 14 and 15. The curved support piece 5 is articulated to the parts 18 and 19 by its arms 5*a* and 5*b* by means of a screw 24 and 25 respectively, screwed into a nut such as the nut 26 in the case of the screw 24, this nut having been embedded in a plastic piece 27, 28 respectively, which has a flat face bearing against the bearing surface 20 and 21 respectively. The support piece 5 is also connected to the auxiliary support 7 via a connecting piece 29 and 30 respectively, allowing the level of the screws 24 and 25 to be modified, that is to say allowing the orientation of the axis of articulation of the support piece 5 on the support 6 to be modified, that is to say allowing the inclination of the mid-plane of the support piece 5 to be adjusted relative to the plane of the base. Such a connecting piece is described in detail in French Patent Application No. 99/13757. The screws 24 and 25 are off-centered on the connecting pieces which have a raised part such as 31 comprising four lobes arranged symmetrically relative to the center of the raised zone, this raised zone fitting into a housing 32 of mating shape formed in the arms 5*a* and 5*b* of the support piece 5 in four different positions.

The means of connecting the support plate 5 therefore allow both the level of the axis of articulation of the support piece 5 to be modified relative to the base and the orientation of this axis of articulation to be modified in space.

The notched faces 22 and 23 of the cheeks 8 and 9 have a horizontal slot for the passage of the screws 24 and 25. The faces of the pieces 27 to 28 bearing against the notched faces 22 and 23 are also notched. It is thus possible to fix the pieces 27 aid 28 at different points on the cheeks 8 and 9. In the context of the construction according to the invention, this possibility for adjustment is used only to longitudinally offset one of the pieces 27 and 28 relative to the other, that is to say to modify the orientation of the curved support piece 5 about its axis of curvature. The parallel shift of the support piece 5 in fore-aft translation is actually performed by shifting the auxiliary support 6 as will be described later on.

The underside of the base 1 has a housing 34 of rectangular cross section, of a depth roughly equal to the thickness of the crosspiece 7, but of a width substantially greater than the width of this crosspiece 7. The end of the housing 34 has two oblong holes 35 and 36 for the passage of the screws 12 and 13. Around the holes 35 and 36, the end of the housing 34 has a notched surface 37 and 38 respectively, collaborating with the notched zones 14 and 15, and the notches of which have the same orientation and the same dimensions as the notches of the notched surfaces 14 and 15 of the auxiliary support. At the extremities of the housing 34, the base 1 has two passages 39 and 39*a* passing through it. In the immediate vicinity of its extremities, the housing 34 has two walls or flutes 40 and 41 extending transversely to the housing 34. The auxiliary support 6 is fixed into the housing 34 by the screws 12 and 13 which screw into the holes 10 and 11 in the crosspiece 7 of the auxiliary support. The cheeks 8 and 9 pass through the passages 39 and 39*a* via their thinner parts 18 and 19 as can be seen in FIG. 1 in the case of the part 19. The parallel walls 40 and 41 engage in the grooves 16 and 17 to guide the auxiliary support. As the housing 34 is substantially wider than the crosspiece 7, the latter can be shifted in a direction parallel to the longitudinal axis of the base and/or about an axis perpendicular to the base and can be fixed in various positions which are maintained by the notches. The heads of the screws 12 and 13 do not of course project from the top side of the base 1, but are recessed and bear on counterbores surrounding the oblong holes 35 and 36.

Figure 4:
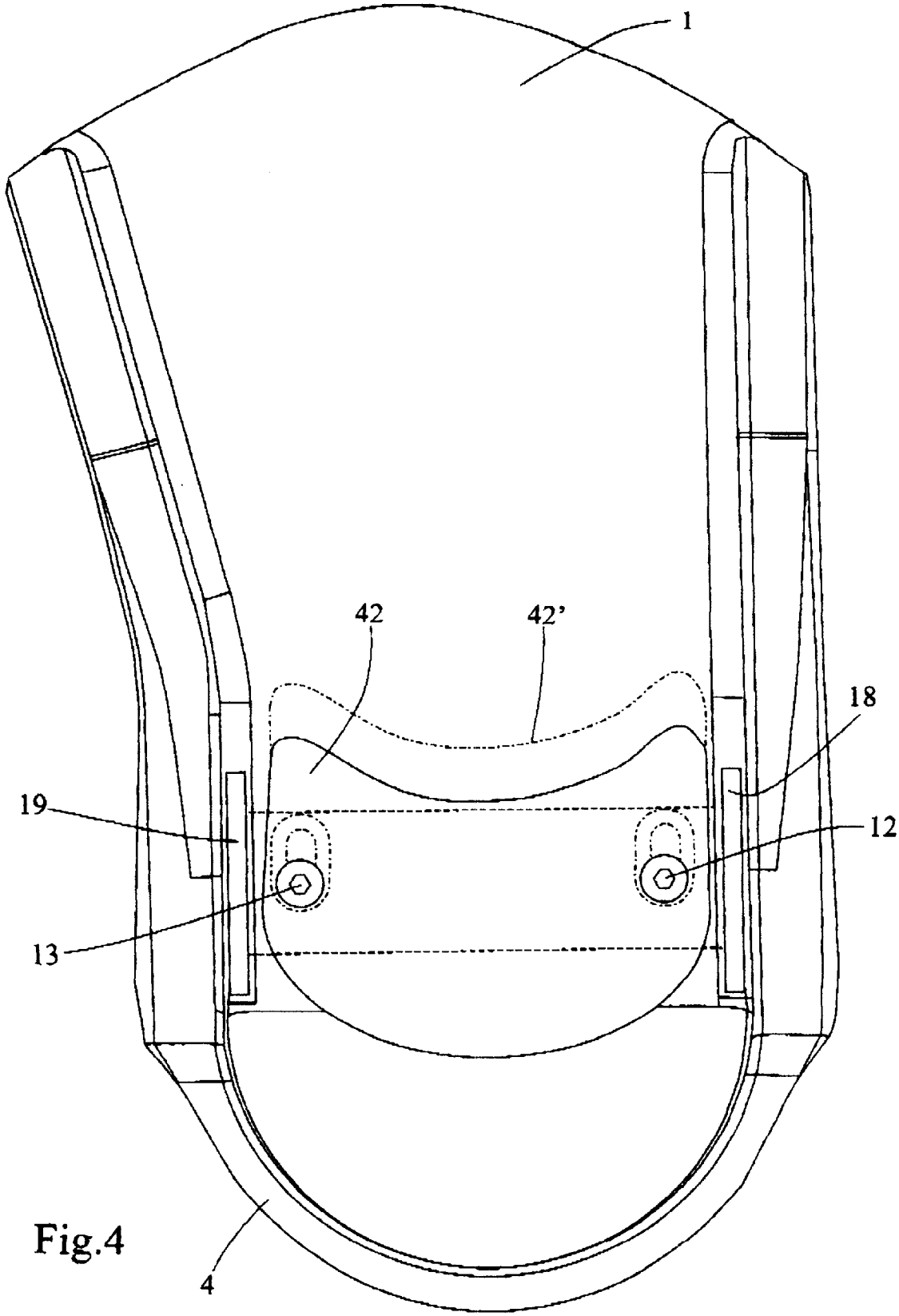
FIG. 4 is a plan view, from above, of the base and of the auxiliary support associated with a heel pad.

The binding may be equipped with a heel pad 42 as depicted in FIG. 4. This pad 42 has, passing through it, the screws 12 and 13 which secure the auxiliary support 6. In consequence, if the auxiliary support is shifted to adapt the position of the curved support piece 5 to suit the boot size of the user, the pad 42 is shifted with this support piece 5, so that it is always in a correct position relative to the heel of the boot. FIG. 4 depicts the two extreme positions of the pad 42 and 42' in solid line and in chain line respectively.

The housing intended to house the auxiliary support could be formed in the top side of the base, but the top side of the base would then no longer have continuity.

In the first embodiment, it is noted that the mounting of the support plate 5 on the cheeks of the crosspiece allows the position of the auxiliary support to be adjusted in the longitudinal direction (FIG. 2).

It would therefore be possible to dispense with the corresponding adjustment of the crosspiece in favor of adjustment about an axis perpendicular to the base.

Figure 5:
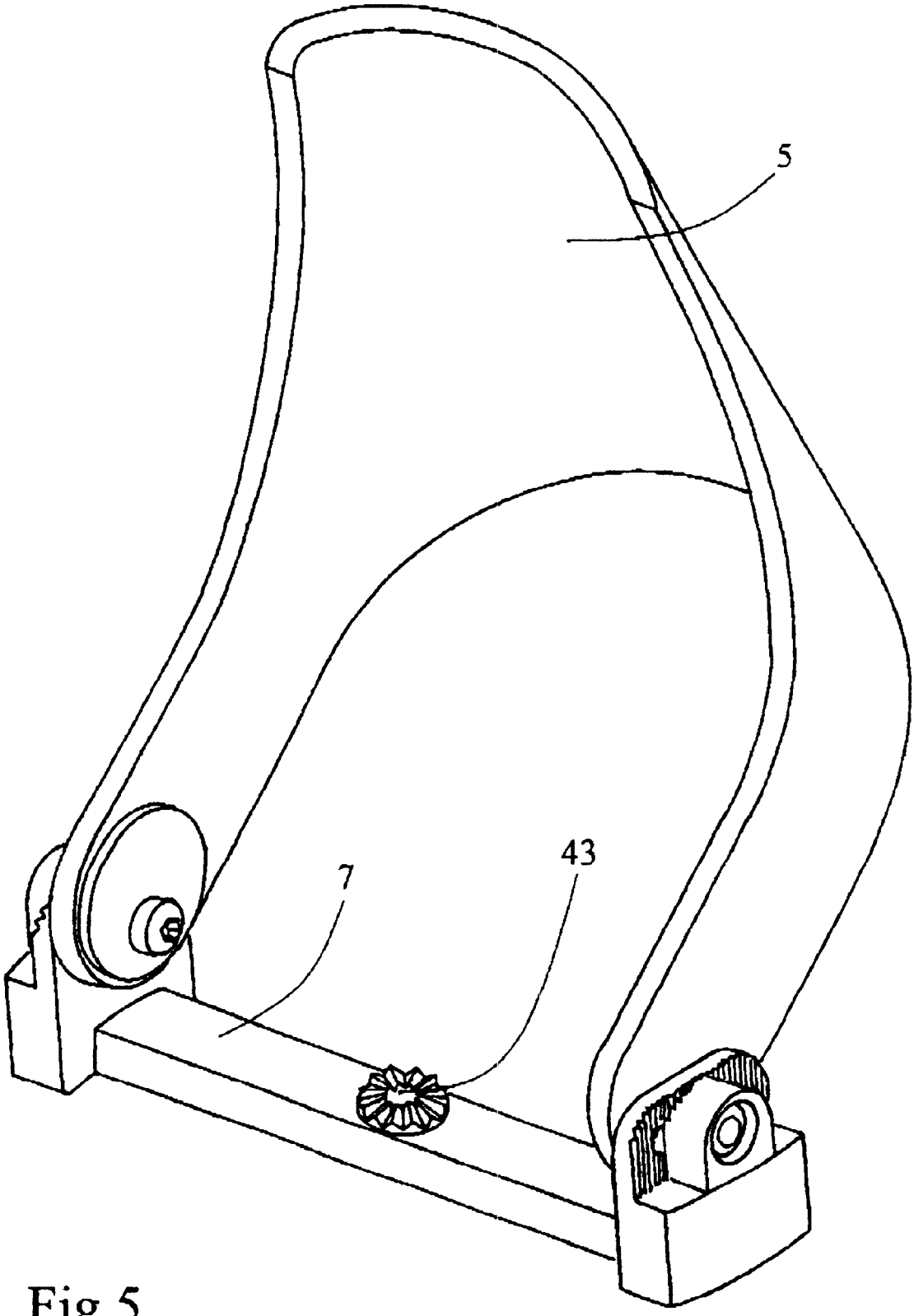
FIG. 5 depicts the auxiliary support according to a second embodiment.
Figure 6:
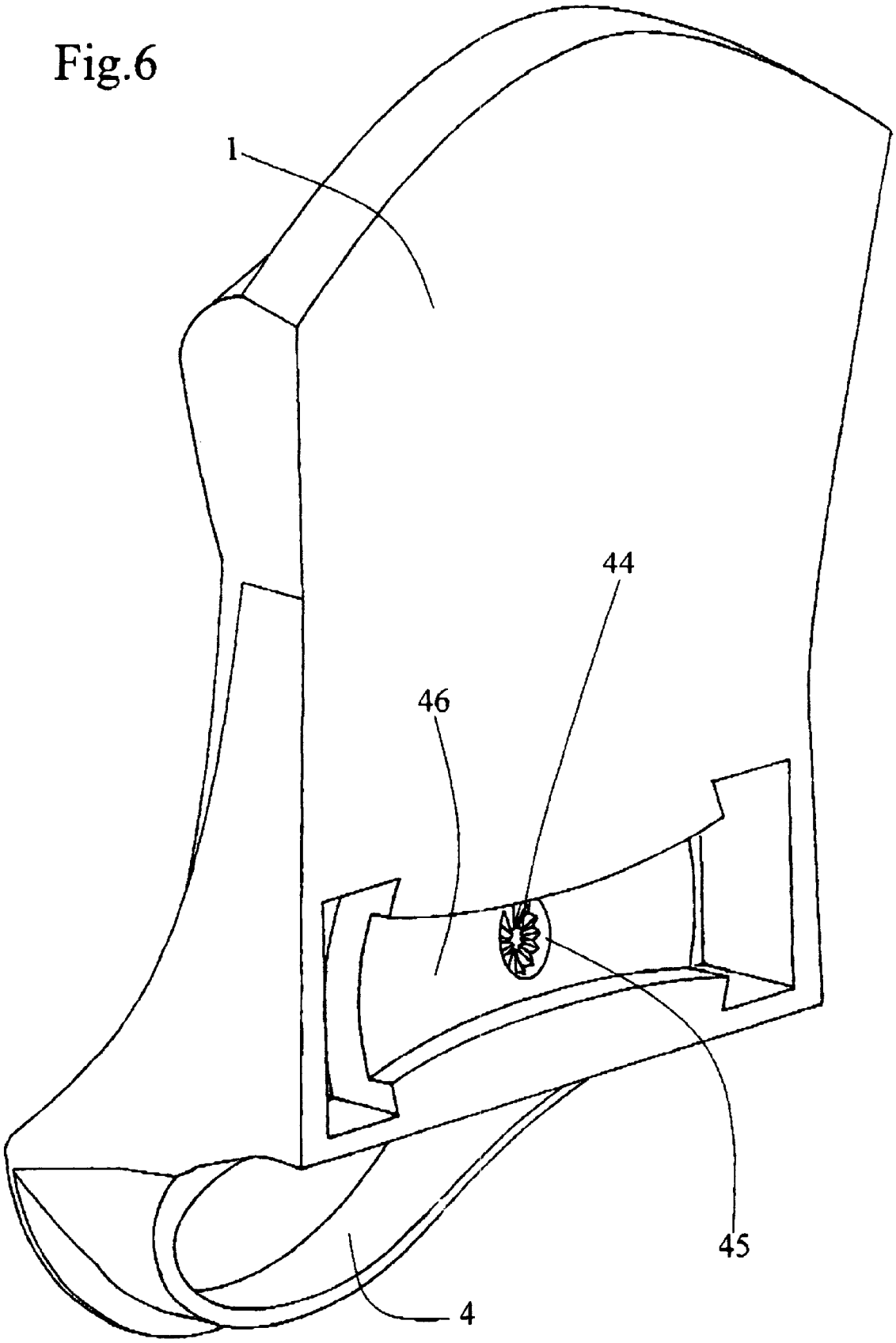
FIG. 6 is a view from beneath of the base of this second embodiment.

FIGS. 5 and 6 depict such an embodiment. The crosspiece 7 is equipped at its center with a circularly, that is to say radially, notched annulus 43. This annulus engages with a corresponding notched annulus 44 formed in a hole 45 in the end of a housing 46 corresponding to the housing 34, but the sides of which are convex so as to allow the crosspiece 7 to rotate slightly. For the rest, this embodiment is identical to the first embodiment.

According to an alternative form, not depicted, the notched annulus 43 could be replaced by a simple pivot engaged in the hole 45 in which the notching would also be omitted. These annuli would be replaced by notching at the extremities of the crosspiece and of the housing.

A third embodiment is depicted in FIGS. 7 and 8.

The base 1 here has a housing formed of a transverse cut-out 47, the end of which is formed by an intermediate component consisting of a plate 48 attached under the base 1 and rotating as one with the base and to which the auxiliary support 6 is fixed.

This plate 48 extends over just part of the cut-out 47 and, in this cut-out, it has parallel notching 49. The crosspiece 7 of the auxiliary support has a radially notched central zone 50. Between the crosspiece 7 and the plate 48 there is an intermediate plate 51 which, on its top side, has radial notching corresponding to the notching 50 and, on its underside, has parallel notching corresponding to the notching 49. The two sides of the plate 51 are also depicted in FIG. 8. The crosspiece 7 is fixed to the plate 48 by a screw 52 and a nut 53.

An alternative form of embodiment is illustrated in FIG. 9. The intermediate plate 51 is replaced by an elongate plate 54, the center of which has a pivot 55 engaged in a corresponding housing of the crosspiece 7. The parallel 56 and radial 57 notchings are formed at the extremities of this plate on the two sides of the plate. Corresponding notchings are formed on the crosspiece 7 and on the plate 48.

Figure 3:
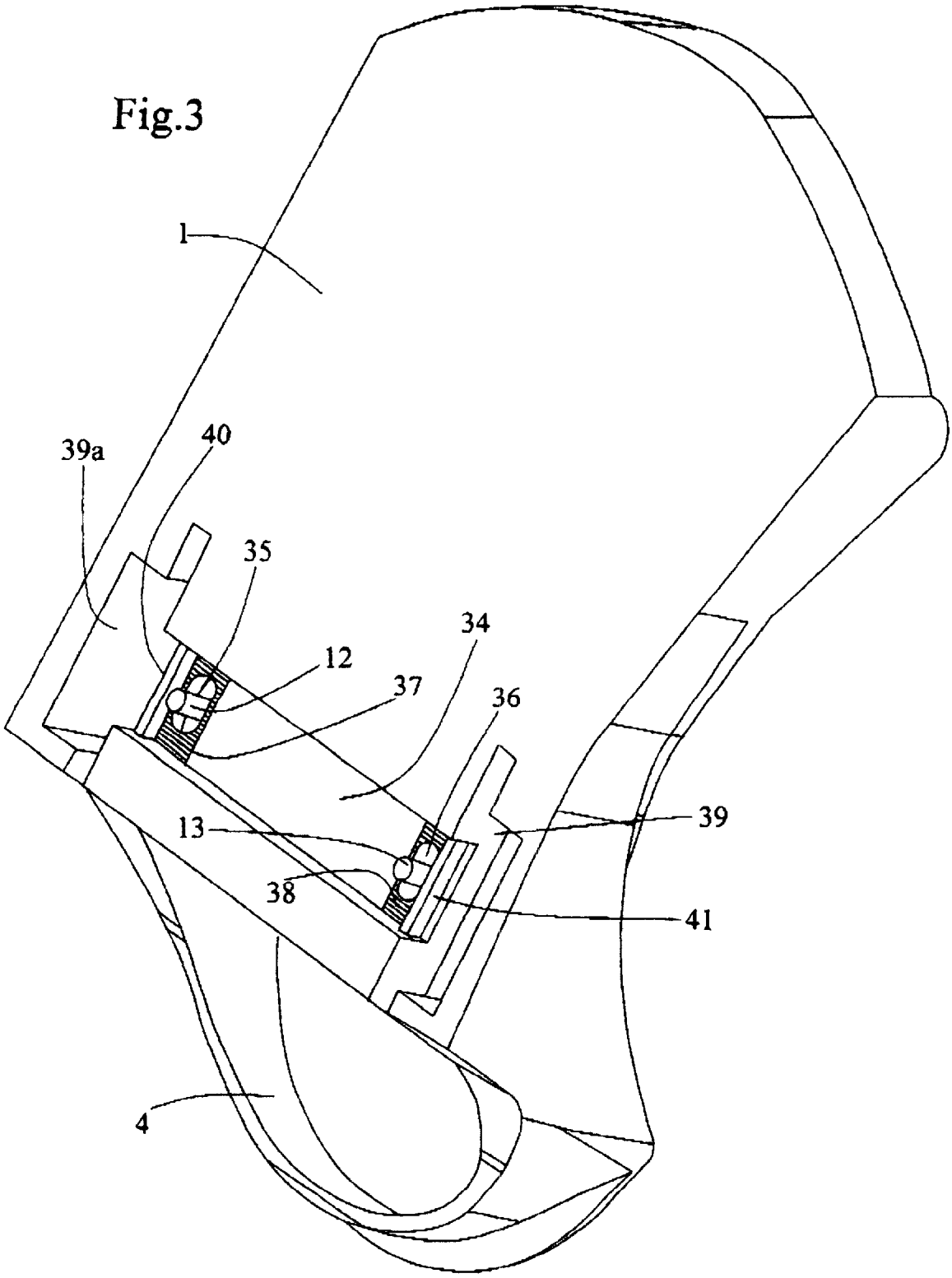
FIG. 3 is a view from beneath of the base of the binding without the auxiliary support.

The plate 48 could extend over all or part of the length of the cutout 47. The bridge-like part penetrating the cut-out 47, that can be seen in FIG. 8, could be a little more pronounced and a little wider so as to form a housing comparable with the housing 34 in FIG. 3, in which housing the crosspiece 7 of the auxiliary support could be fixed to the plate 48.

Multiple variations and modifications are possible in the embodiments of the invention described here. Although certain illustrative embodiments of the invention have been shown and described here, a wide range of modifications, changes, and substitutions is contemplated in the foregoing disclosure. In some instances, some features of the present invention may be employed without a corresponding use of the other features. Accordingly, it is appropriate tat the foregoing description be construed broadly and understood as being given by way of illustration and example only, the spirit and scope of the invention being limited only by the appended claims.

What is claimed:

1. A snowboard binding comprising a base (1) for mounting on a snowboard and having side wails (2, 3) having forward and rear portions, a bow shaped structure (4) connecting the rear portions, a curved support plate (5) having opposite ends articulated on corresponding opposite ends of an auxiliary support (6), the curved support plate having a curvature which corresponds roughly to the curvature of the bow shaped structure (4), wherein the auxiliary support is adjustably secured to the base (1), wherein the auxiliary support is fixed directly to the base between the side walls (2, 3) by an adjustment device (7, 12, 13) allowing the support's position relative to the base to be modified.

2. The binding as claimed in claim 1, wherein the auxiliary support (6) has a crossmember (7) housed in a housing (34; 46) formed in the underside of the base or of the intermediate component, this crossmember having mounting flanges (8, 9) passing through the base proximate the side walls of the base.

3. The binding as claimed in claim 2, wherein the crossmember (7) has two notched zones (14, 15) cooperating with two notched zones (37, 38) of the end of the housing (34) of the base, allowing the position of the auxiliary support to be modified in the longitudinal direction of the base and/or about an axis perpendicular to the base.

4. The binding as claimed in one of claims 2 and 3, wherein the curved support plate (5) is articulated on the mounting flanges (8, 9) of the auxiliary support via connecting means (27, 28, 29, 30) allowing both the level of the axis of articulation of the support piece (5) to be modified relative to the base and the orientation of this axis of articulation to be modified in space.

5. The binding as claimed in claim 1, wherein the curved support plate (5) is articulated on the mounting flanges (8, 9) of the auxiliary support via connecting means (27, 28, 29, 30) allowing both the level of the axis of articulation of the support piece (5) to be modified relative to the base and the orientation of this axis of articulation to be modified in space.

6. The binding as claimed in claim 5, wherein the means (24, 27, 25, 28) of connecting the curved support plate (5) to the auxiliary support (6) comprise vertically notched pieces (27, 28) cooperating with vertically notched surfaces (22, 23) of the auxiliary support.

7. The binding as claimed in claim 6, wherein the means of connecting the curved support plate (5) to the auxiliary support (6) further comprise connecting pieces (29, 30) through which screws (24, 25) pass eccentrically, these screws defining the axis of articulation, these pieces being insertable into the support plate (5) in various angular positions defining various articulation levels.

8. The binding as claimed in claim 7, wherein the insertable pieces (29, 30) have a raised part (31) that can be inserted in various angular positions into a housing (32) of mating shape of the support piece (5).

9. The binding as claimed in one of claims 1, 2, 3, 5, 6, 7, and 8, and which comprises a heel pad (42) which translates as one with the auxiliary support (6).

* * * * *